US010295123B2

(12) United States Patent
Su et al.

(10) Patent No.: US 10,295,123 B2
(45) Date of Patent: May 21, 2019

(54) BULB APPARATUS AND MANUFACTURING METHOD THEREOF

(71) Applicant: Leedarson Lighting Co., Ltd., Zhangzhou, Fujian (CN)

(72) Inventors: Lilei Su, Fujian (CN); Mingyan Fu, Fujian (CN); Hongkui Jiang, Fujian (CN); Hongbin Lin, Fujian (CN); Yanzeng Gao, Fujian (CN); Guangai Chen, Fujian (CN)

(73) Assignee: LEEDARSON LIGHTING CO., LTD., Zhangzhou, Fujian (CN)

( * ) Notice: Subject to any disclaimer, the term of this patent is extended or adjusted under 35 U.S.C. 154(b) by 0 days.

(21) Appl. No.: 15/835,035

(22) Filed: Dec. 7, 2017

(65) Prior Publication Data

US 2018/0372276 A1 Dec. 27, 2018

(30) Foreign Application Priority Data

Jun. 26, 2017 (CN) ..... 2017 1 0492611

(51) Int. Cl.

| | |
|---|---|
| ***F21K 9/00*** | (2016.01) |
| ***F21K 9/232*** | (2016.01) |
| ***F21K 9/235*** | (2016.01) |
| ***F21K 9/238*** | (2016.01) |
| ***F21V 3/02*** | (2006.01) |
| ***F21V 19/00*** | (2006.01) |
| ***F21V 29/70*** | (2015.01) |
| ***F21V 23/00*** | (2015.01) |
| ***F21K 9/90*** | (2016.01) |
| ***F21V 29/89*** | (2015.01) |

(Continued)

(52) U.S. Cl.

CPC ..... *F21K 9/232* (2016.08); *F21K 9/235* (2016.08); *F21K 9/238* (2016.08); *F21K 9/90* (2013.01); *F21V 3/02* (2013.01); *F21V 19/0015* (2013.01); *F21V 23/003* (2013.01); *F21V 29/70* (2015.01); *F21V 29/89* (2015.01); *F21Y 2107/50* (2016.08); *F21Y 2115/10* (2016.08)

(58) Field of Classification Search

CPC ..... F21K 9/232; F21K 9/238; F21K 9/235; F21K 9/90; F21V 29/70; F21V 29/89; F21V 3/02; F21V 19/0015; F21V 23/003

See application file for complete search history.

(56) References Cited

U.S. PATENT DOCUMENTS

2005/0207152 A1* 9/2005 Maxik ..... F21K 9/90 362/231

2011/0254423 A1* 10/2011 Lee ..... F21K 9/232 313/46

(Continued)

*Primary Examiner* — Daniel A Hess

(74) *Attorney, Agent, or Firm* — Chun-Ming Shih

(57) ABSTRACT

A bulb apparatus including a bulb, a light cap, a light source assembly and a driving component. The light cap has an inner wall and an outer wall. The outer wall is used for accessing to an external power source. The light source assembly includes a base and the multiple light source components. The base carrying the multiple light source components which form an angle with respect to a predetermined position with respect to the bulb. The bottom outer shape of the base is connected with the inner wall of the light cap. The driving component is disposed in a hole surrounded by the base. The driving component is connected to external power source through a terminal.

4 Claims, 9 Drawing Sheets

(51) Int. Cl.
*F21Y 107/50* (2016.01)
*F21Y 115/10* (2016.01)

(56) References Cited

U.S. PATENT DOCUMENTS

2014/0126213 A1* 5/2014 Pattekar ..... F21V 29/83
362/294
2014/0375202 A1* 12/2014 Yang ..... F21V 29/004
313/36
2015/0098223 A1* 4/2015 Su ..... F21V 29/51
362/249.02
2015/0377421 A1* 12/2015 Chen ..... F21K 9/135
362/235
2016/0341370 A1* 11/2016 Dekker ..... F21V 29/004

* cited by examiner

BULB APPARATUS AND MANUFACTURING METHOD THEREOF

TECHNICAL FIELD

The present invention relates to a bulb apparatus and a method of manufacturing a lighting apparatus, and particularly to a bulb apparatus for a light emitting diode (LED) and a method of manufacturing the LED lighting apparatus.

BACKGROUND OF INVENTION

With years of technology advances and cost reduction of the LED technology, the LED devices are used in various applications An LED is usually better than a traditional tungsten light for luminous efficiency. However, heat dissipation is important to LED components.

SUMMARY OF THE INVENTION

According to one embodiment of the present invention, a bulb apparatus includes a bulb, a light cap, a light source assembly and a driving component. The light cap has an inner wall and an outer wall. The outer wall is used for connecting to a corresponding shaped receptacle for accessing an external power source. The light source assembly includes a base and the multiple light source components. The base carrying the multiple light source components makes the multiple light source components face an angle with respect to a predetermined position with respect to the bulb. The bottom outer shape of the base is connected with the inner wall of the light cap.

The driving component is disposed in a hole surrounded by the base. The driving component is connected to an external power source through a terminal and converts the external power source into a current suitable for driving multiple light source components for driving the multiple light source components to emit light.

In one of design examples, the multiple light source components and the base may share the same substrate. In other words, the multiple light source components may be constructed of the same substrate as the base. For example, at the time of manufacture, an aluminum substrate or other materials may be used to obtain the desired shape with way of cutting and punching. The multiple LED chips are set in a predetermined region of the substrate. In order to allow the appropriate current to be received between the LED chips, a corresponding conductor or a conductive plate which may increase the heat dissipation may be added directly on the substrate. The LED chips electrically connect in parallel, in series, or in other corresponding connecting ways via a corresponding conductor or a conductive plate.

In order to increase heat dissipation, the material of the same substrate may include aluminum. Besides aluminum, multiple different heat dissipation material may also be selected. The substrate is connected to the light source components, so the whole also be regarded as a radiator. The LED chips or LED module may be directly attached to the substrate, or may be a module, and then fixed to the substrate by means of glue, welding and so on. In addition, a heat dissipation material may be coated between the LED chips and the substrate, for example, the heat dissipation material keeping in a gel state, and the heat dissipation material increases the heat transfer effect between the LED chips and the substrate.

In another type of design, the same substrate material is a heat sink. In addition, for making efficiency, the substrates may be formed by cutting or punching with the same complete material layer or sheet of material. In addition, in different types of design, you may also use multiple pieces of material stitching, pasting or welding, etc. to constitute the substrate. In addition, the substrate may have more than one layer of material. For example, some layers are wire layers, which are responsible for series-connected LED chips. Some layers are connected to a layer of aluminum plates for heat dissipation. Some layers are insulating layers, avoiding short circuits to occur between circuit elements.

In one embodiment, the same substrate may be folded to form a three-dimensional hollow light source assembly. For example, we may cut a substrate into the desired shape. The substrate may have multiple forked strips for placing the LED. Also, the substrate may have a base portion, the multiple forked strips connect to the base portion. The substrate may be formed by folding, for example, the substrate is formed a three-dimensional structure by curling. The substrate may be preliminarily set with a folding groove so that the substrate may accurately and easily fold out the desired corner when folded.

The intermediate portion of the base may have at least one hole to enhance heat dissipation. Through the way of folding the substrate, the bottom of the base area surrounded by circular holes or polygonal holes. The top is extended from the substrate of multiple light source assemblies.

The folded substrate may be placed directly into an injection molding machine to inject a predetermined plastic layer on the inside, outside or both sides of the base area of the substrate. The Plastic layer injected through a plastic injection molding machine may be closely bonded to the substrate base area through the injection molding.

The outside of the plastic layer corresponds to the inner wall of the light cap. In other words, the base of the plastic molding plastic layer may be directly transferred into or embedded in the corresponding light cap. Screw thread may be produced on the plastic layer. With the screw thread, the plastic layer combines with the light cap by rotation. In addition, the plastic layer may also be designed to snap, groove, bump, etc. to connect with the light cap.

A heat dissipating glue may also be added between the bottom of the base and the inner wall of the light cap to further increase heat transfer. In other words, the heat from the LED chips on the substrate may transmit to the base region of the substrate through the substrate and convey to the light cap through the plastic layer.

In addition, in order to get the light to follow the desired path, the light source components may include an aluminum substrate with multiple LED chips. The multiple LED chips are arranged on the aluminum substrate and the aluminum substrate is extended in a predetermined manner so that different LED chips on the same aluminum substrate emit light toward two or more angles. As mentioned above, the substrate may be an aluminum substrate. At this time, the aluminum substrate may be bent by bending and so on, for example, bending into a curve, or multiple paragraphs bent into multiple relative angles. In this way, in different paragraphs, or different areas of the LED chips may have a different light injection angle. By adjusting the relative angle of the aluminum substrate or substrate made by several materials at different positions, the LED chips may emit light in a desired direction so that the light emission of the entire lighting apparatus conforms to the desired light distribution.

In particular, one of the practices includes bending the aluminum substrate at an upper end at an angle such that different LED chips on both sides of the bent position emit light at different angles. In other words, the LED chips above the bent position emits light toward the first angle and the LED chips below the bent position emits light toward the second angle, wherein the first angle and the second angle remain constant big difference, so that light may be fired in different directions. Typically, the main beam angle of the LED chips are about 120 degrees. When designing the substrate, you may create the beam angles of LED chips at different area overlap for general lighting and ambience.

In addition, if it is a common Edison light cap, the center of the light cap is a cylindrical hole. The central axis of the cylindrical hole has a central axis direction. By bending a local region of a substrate such as an aluminum substrate so that at least one or more light emitting direction of the LED chips center is different from the central axis direction by 30 degrees or more.

In addition, as described above, the substrate may be set with multiple intersecting strips for setting the LED chips. The multiple crossings may have a certain gap between them for better heat dissipation. For example, the light source assembly has the multiple aluminum substrates, and the multiple aluminum substrates have a slit so that air flows between the inner space surrounded by the multiple aluminum substrates and other spaces in the bulb to have heat dissipation.

In one embodiment, the sum of the widths of the gaps is between one-third and one-half of the sum of the widths of the multiple aluminum substrates, and the sum of the widths of the gaps is equal to the sum of the widths of the multiple aluminum substrates. The sum of the widths respectively, refer to the sum of the gaps between the multiple aluminum substrates and the sum of the widths of the plurality of aluminum plates, of the three-dimensional structure of the light source assembly during assembly.

In order to introduce a current into the LED chip, the bulb apparatus further includes an electrical connection terminal, and the multiple light source components are connected to the driving component through the electrical connection terminal. The electrical connection terminals may be used to form the desired conductive structure with shrapnel, springs, wires or multiple different configurations.

Of course, in addition to the conventional bulb apparatus, the substrate with three-dimensional structure by bending may be used in different lighting apparatus such as downlights and spotlights, etc. The area in which the light source board is originally set may be changed to multiple light source components having a long strip shape in a part of the region by a substrate. A light source such as a LED chip is set thereon, and then the region of the light source component is bent so that the LED emits light toward the desired place.

According to another embodiment of the present invention, there provides a method of manufacturing an illumination device. The method includes the following steps.

First, multiple light source component regions are formed on one substrate, and multiple LED chips are set in each of the light source component regions, wherein the multiple light source component regions have gaps.

The substrate is folded to form a three-dimensional hollow light source assembly. The multiple light source component regions of the substrate and a corresponding multiple LED chips constitute multiple light source components. The gaps between the multiple light source component regions allow the airflow to dissipate heat.

Bending the light source so that different LED chips on both sides of the light source are bent toward different angles.

The light source assembly is combined with the power supply connector.

In other words, the bulb apparatus may be manufactured by this method. Moreover, such a manufacturing method may bring high-efficiency and low-cost technical effects.

In addition, the method may also include forming a plastic layer by injection molding at the bottom of the light source assembly, the plastic layer corresponding to the shape of the power supply connector.

In addition, the method may also include cutting two substrates on a sheet, the two substrates being disposed backwards, and the two substrates being staggered on the panels in a portion of the panel. In other words, the method may be for a large area of the substrate with the corresponding LED chip set and then cut. Since the gap between the light source components is staggered, it is equal to the gap of the substrate of one lamp, and is the position of the light source board of the substrate of the other light. Through the approach may not waste material, and may achieve more environmentally friendly and reduce the cost of the effect.

The substrate may include an aluminum substrate, and furthermore, the intermediate sidewall of the light source assembly may further be set with holes to increase heat dissipation, such as increasing the flow of gas.

Through the above design method, we may achieve lower manufacturing costs and better cooling efficiency, while maintaining the excellent characteristics of lighting.

DETAILED DESCRIPTION

Figure 4:
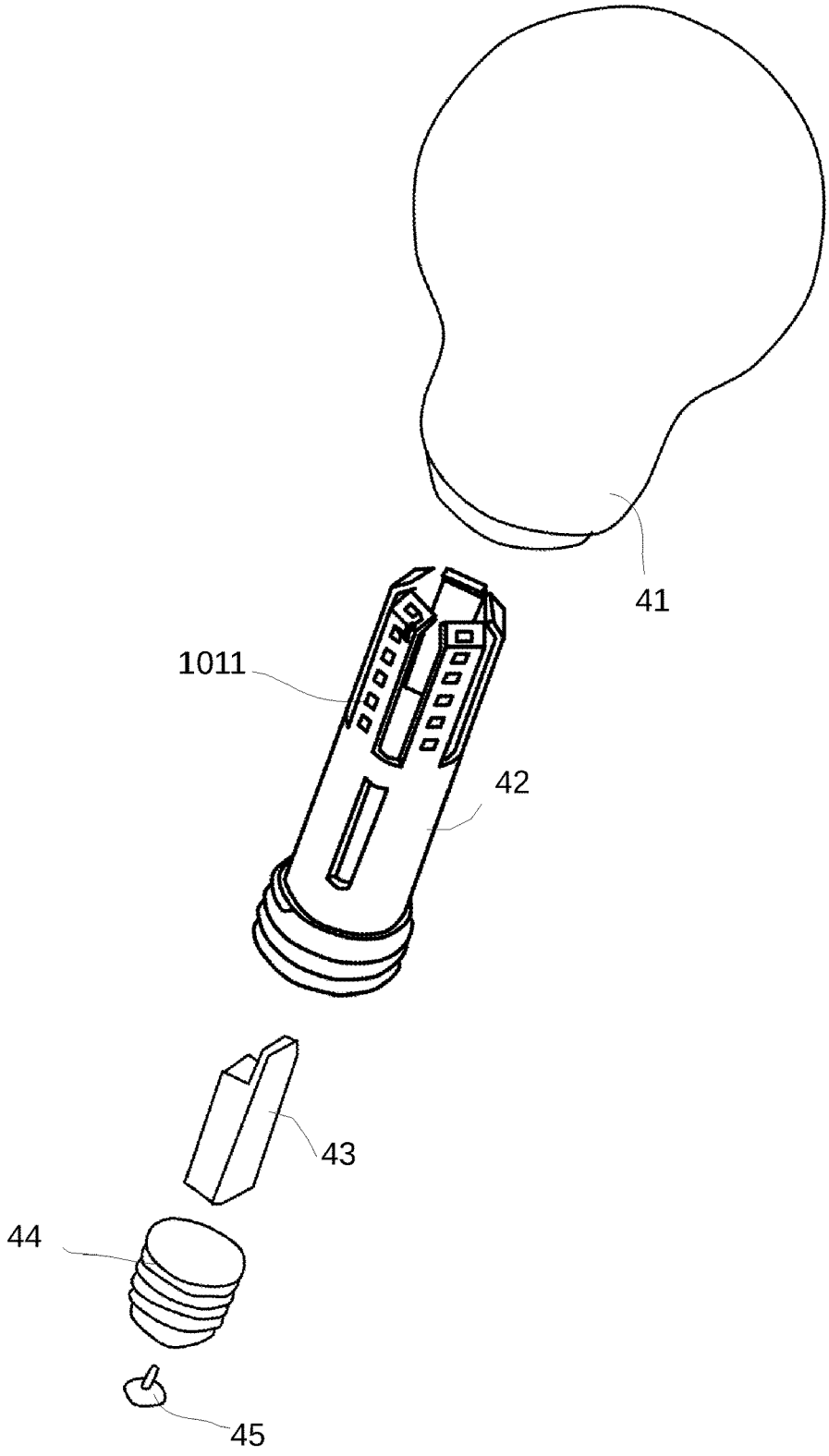
FIG. 4 illustrates an exploded view of the various elements of a bulb apparatus.

Please refer to FIG. 4, according to a first embodiment of the present invention, there provides a bulb apparatus including a bulb 41, a light cap 44, a light source assembly 42 and a driving component 43. The light cap 44 has an inner wall and an outer wall. The outer wall of the light cap is used for connection to a corresponding shaped receptacle (not shown), and accesses to an external power source (not shown in the Fig).

Figure 1:
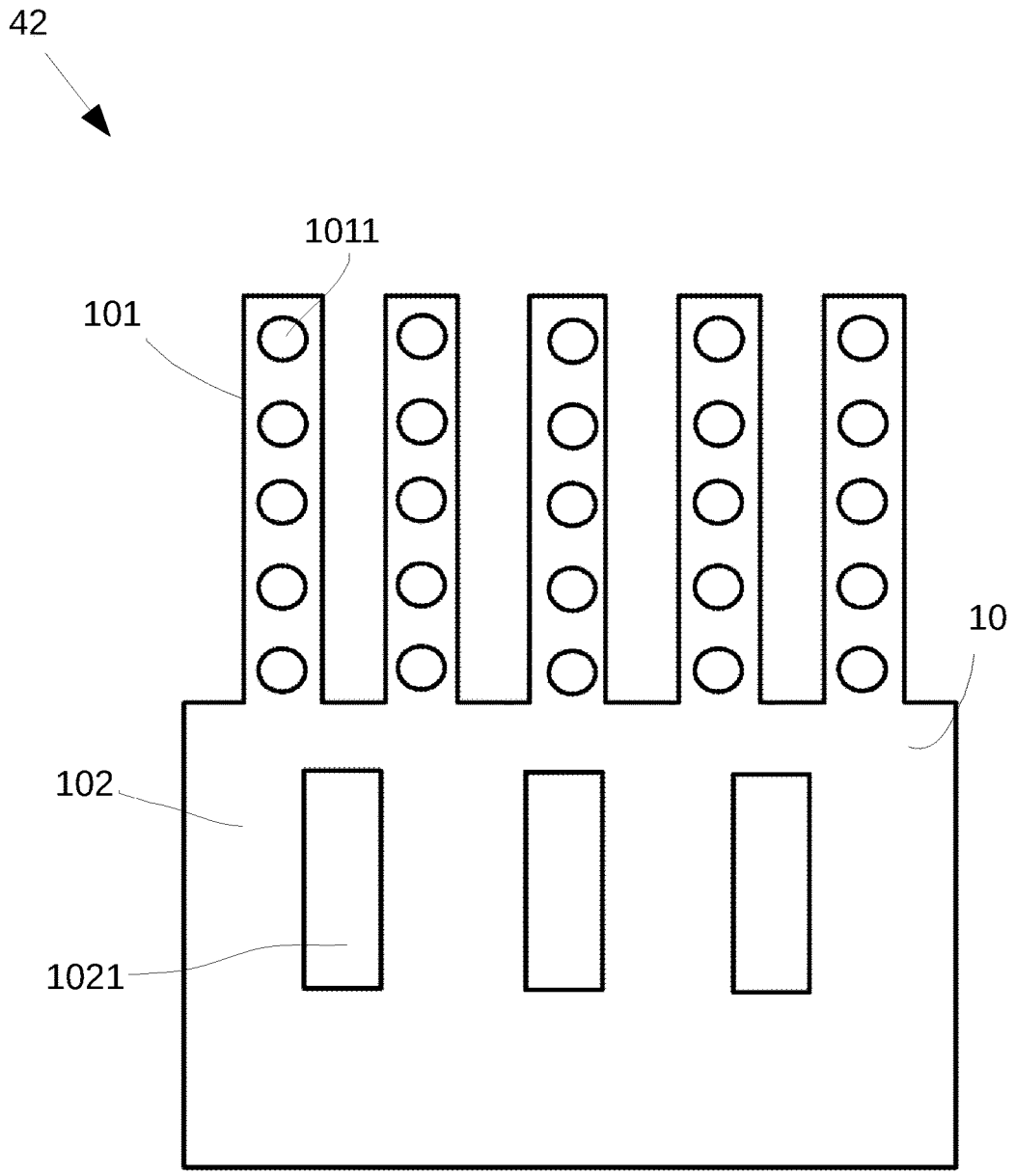
FIG. 1 illustrates an embodiment of a light source assembly.

Please refer to FIG. 1 and FIG. 4, the light source assembly 42 includes a base 102 and multiple light source components 101. The base 102 carries light source components 101 so that the multiple light source components 101 are oriented at an angle with respect to the predetermined position of the bulb 41. The bottom outer shape of the base 102 is engaged with the inner wall of the light cap 44 at the time of assembly.

The driving component 43 is disposed in a hole surrounded by the base 102. The driving component 43 is connected to the external power source through a terminal (not shown), and the external power source is converted into a current suitable for driving the multiple light source components 101 for driving the multiple light source components 101 to emit light.

Then, we illustrate the characteristics of each component through a series of graphs.

Please refer to FIG. 1, which illustrates an embodiment of a light source assembly. In this example, the body of the light source assembly 42 is a substrate 10. Elements of different functions are set in different areas of the substrate 10. In the light source assembly 42 of this example, there are five light source components 101, each light source components 101 is an elongated shape, and an LED chip 1011 is set on its surface. In some cases, the LED chip 1011 may constitute an LED chip module, also belongs to the side of the concept of LED chip. Below the substrate 10 is a base 102. The base 102 may also further provide one or more apertures 1021 to increase the heat dissipation effect of the substrate 10.

Figure 2:
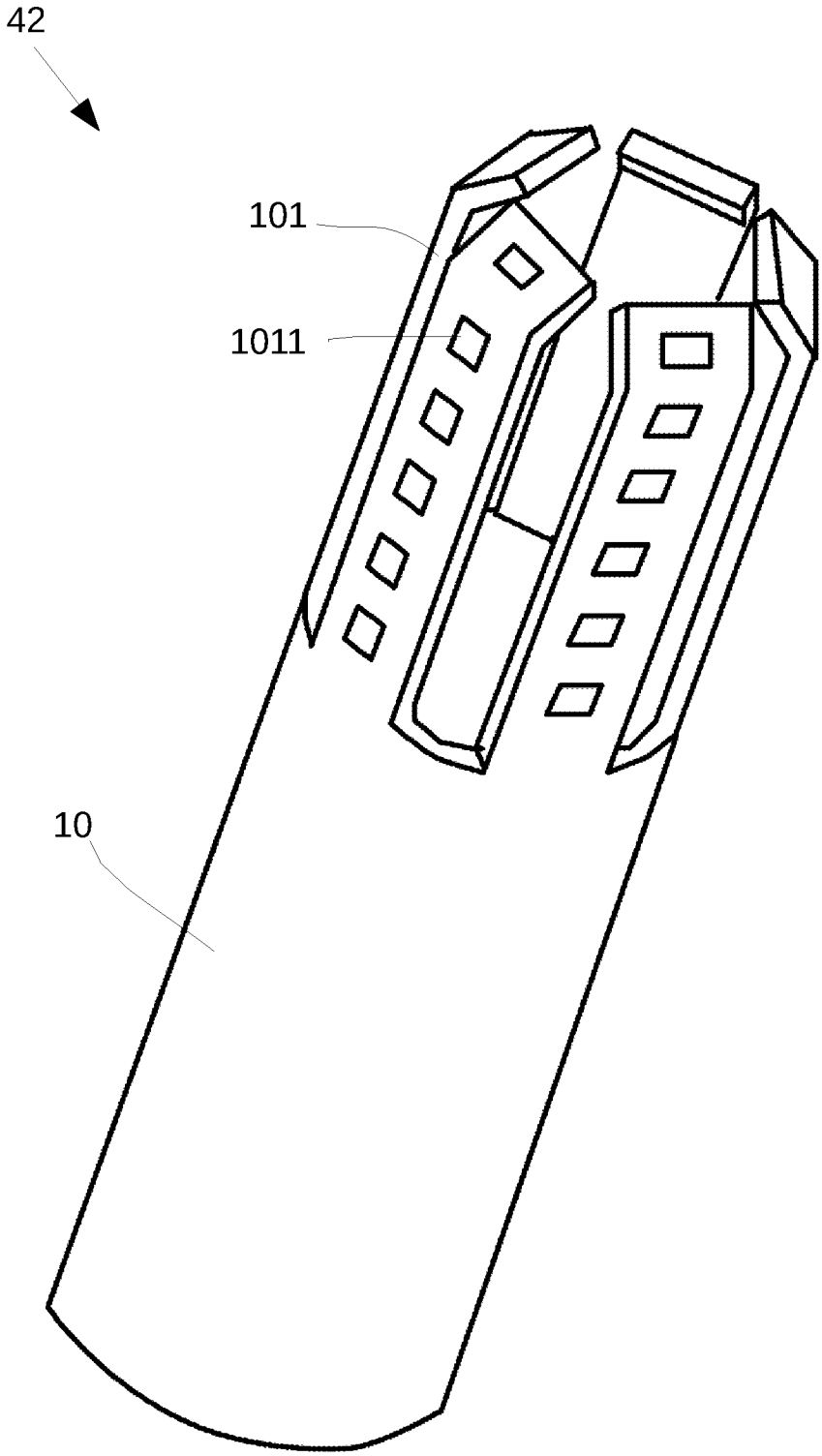
FIG. 2 illustrates a schematic representation of a light source assembly folded into a three-dimensional structure.

Next, please refer to FIG. 2, which illustrates a schematic representation of a light source assembly folded into a three-dimensional structure. We may add a folding groove to the light source assembly 42 described in FIG. 1 so as to be folded into a three-dimensional structure of a polygonal shape. Alternatively, the light source assembly 42 shown in FIG. 1 may be folded into a three-dimensional structure of a substantially hollow cylinder. When the substrate 10 is used as an aluminum substrate, it has a certain degree of fix ability. In other words, when the external force is removed, the light source components 101 holds the set three-dimensional structure. In order to make this three-dimensional structure more stable, you may also put in the folding side of the convex, buckle, groove or glue, welding and other processing procedures.

Figure 3:
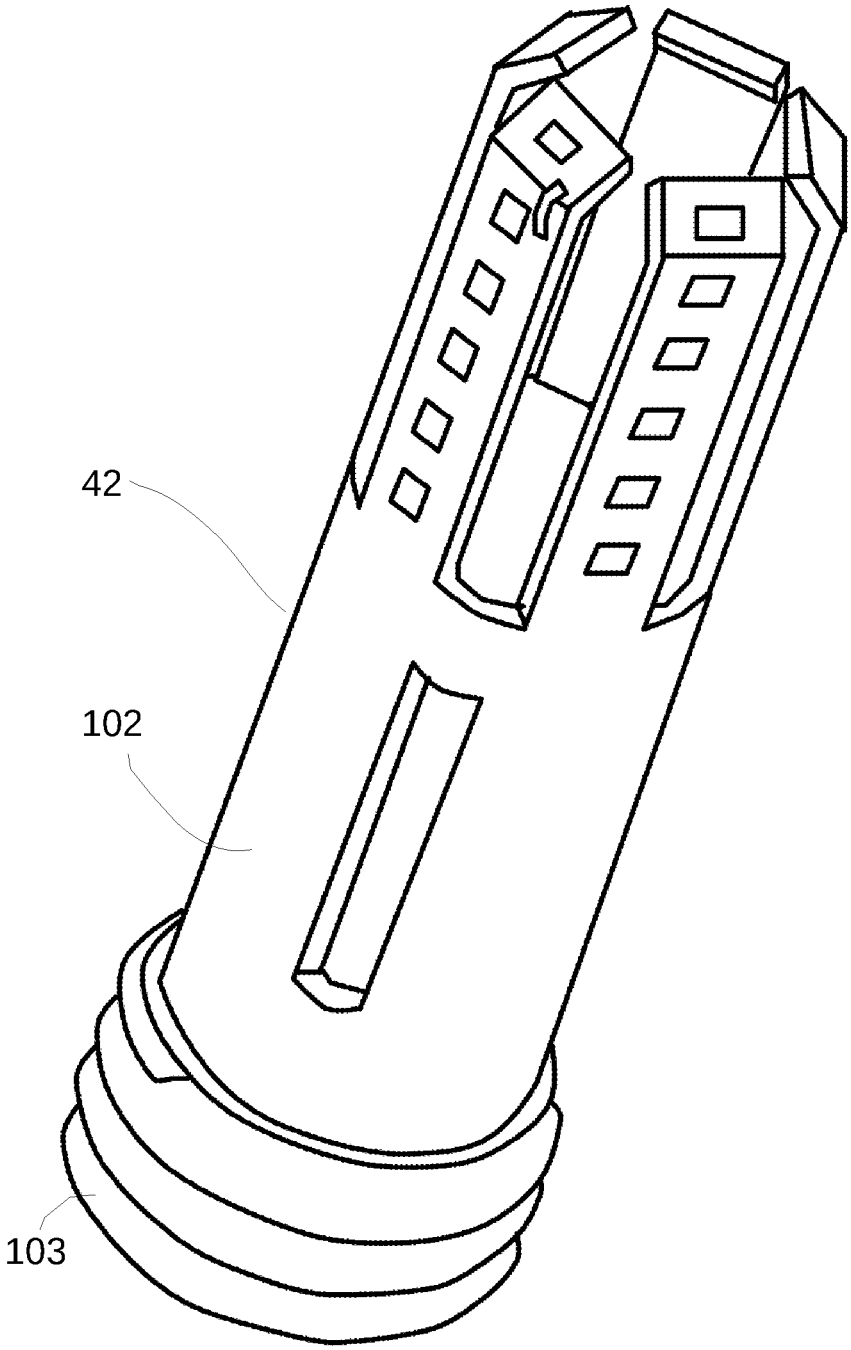
FIG. 3 illustrates a schematic diagram of a light source assembly incorporating an injection plastic layer.

Next, please refer to FIG. 3, which illustrates a schematic diagram of a light source assembly 42 incorporating an injection plastic layer 103. The light source assembly 42 shown in FIG. 2 may be placed directly into the injection molding machine (not shown) after forming the three-dimensional structure, and a plastic layer 103 of a predetermined shape is formed in the area of the base 102. The plastic layer 103 may be made of a plastic material having a better thermal conductivity as the original substrate, and the plastic layer 103 may be closely engaged with the base 102 due to the injection molding process so that the base 102 and the plastic layer 103 have good thermal connection effect. Of course, the structure in which the plastic layer 103 is responsible may also be achieved with a heat dissipating glue or a sleeve having a heat dissipation function.

Next, please refer to FIG. 4, which illustrates an exploded view of the various elements of a bulb apparatus. The bulb 41 covers the light source assembly 42. The hollow hole of the light source assembly 42 is inserted into the driving component 43. The driving component 43 is connected to a light cap 44 such as Edison via a suitable electrical connection terminal 45.

The driving component 43 is provided with a current for converting the external power source into a voltage suitable for driving the LED chip 1011. And the current is directed to the LED chip 1011 on the light source assembly 42 with a terminal or a wire.

In the example, the bulb is used as an example of implementing the invention. In other examples, the light source assembly 42 may be connected to a battery. The bulb 41 may also be a variety of transparent or translucent covers or boards or related devices with lenses that are different from this example. For example, the LED chip 1011 may direct light to a light guide plate made of laser light or a refraction plate composed of a plurality of micro lenses to achieve the desired light effect.

Figure 5:
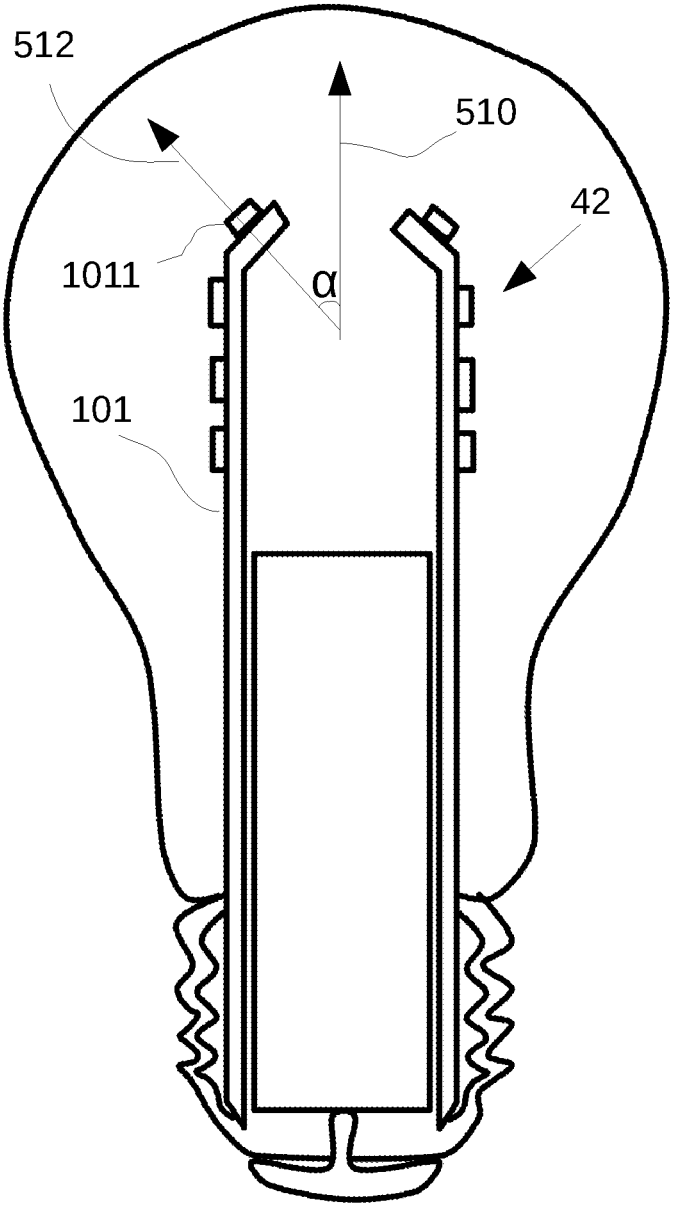
FIG. 5 illustrates a cross-sectional view of an embodiment of a bulb apparatus.

Next, please refer to FIG. 5, which illustrates a cross-sectional view of an embodiment of a bulb apparatus. The beam axis 512 of at least one LED chip 1011 on the light source components 101 and the central axis 510 of the light source assembly 42 form an angle $\alpha$. The angle $\alpha$ is more than 30 degrees.

In another embodiment, in order to achieve a different light distribution effect, the beam axis 512 of at least one LED chip 1011 on the light source components 101 and the central axis 510 of the light source assembly 42 form an angle $\alpha$. The angle $\alpha$ is under 30 degrees. In some cases, the angle $\alpha$ is between 30 degrees and 90 degrees.

Figure 6:
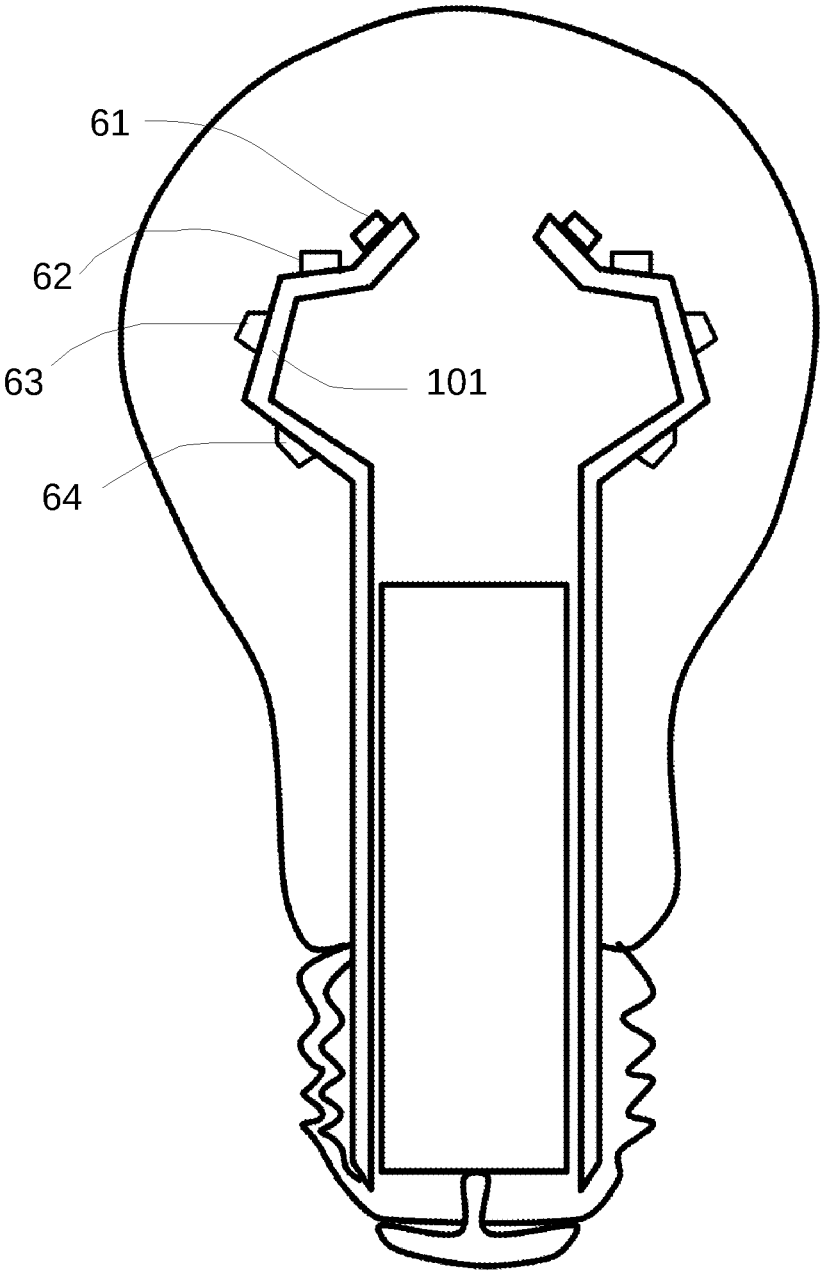
FIG. 6 illustrates another embodiment of a beam angle setting.

Next, please refer to FIG. 6, which illustrates another embodiment of a beam angle setting. In FIG. 6, the light source component 101 has four LED chips 61, 62, 63, and 64. The emission angles of the four LED chips 61, 62, 63, 64 are set to more than three different directions to achieve a more uniform light emission effect.

Figure 7:
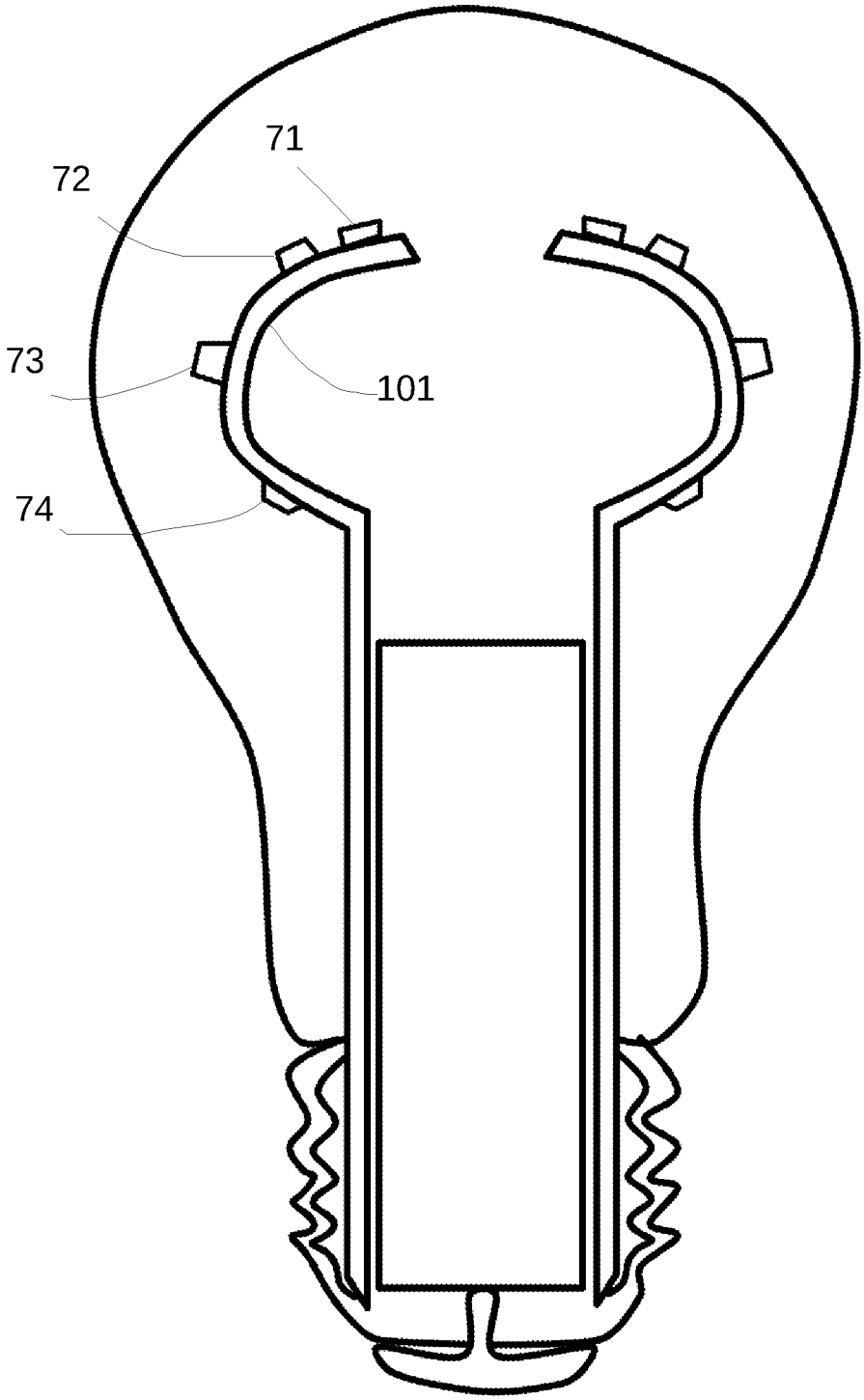
FIG. 7 illustrates another embodiment of a beam angle setting.

Next, please refer to FIG. 7, which illustrates another embodiment of a beam angle setting. The light source component 101 on the optical module of FIGS. 6 and 7 is bent at an arc angle so that the LED chips 71, 72, 73, 74 set on the light source component 101 may emit light toward a predetermined angle.

In addition, in this example, the light source component 101 may be set with a relatively dense LED chip, such as the LED chips 71, 72, at a position distant from the light cap to achieve the effect of enhancing the emission of light in a particular area. If the requirements of different light bulbs, you may adjust the different light source density in different locations.

Figure 8:
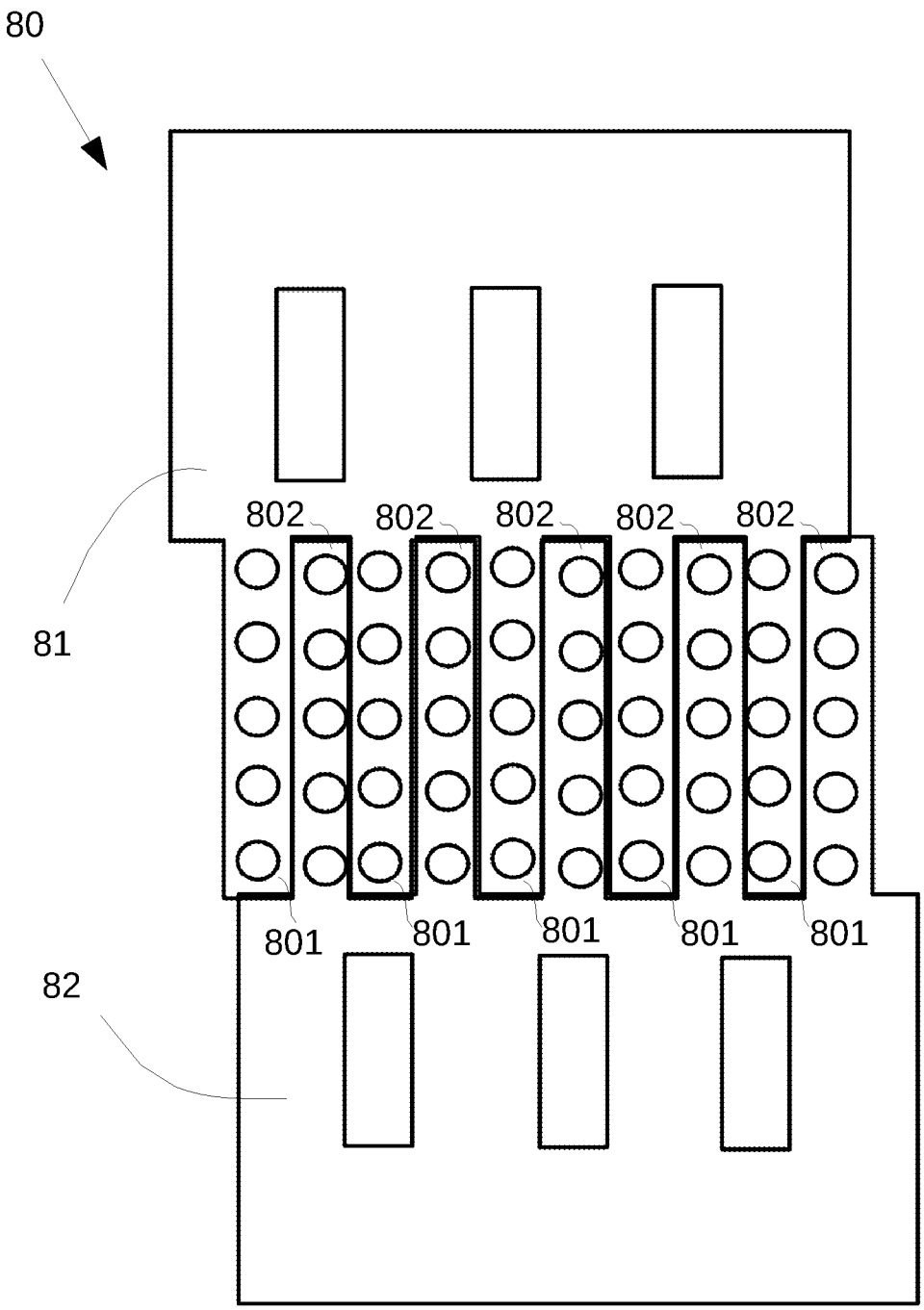
FIG. 8 illustrates a schematic diagram of partitioning a large area substrate and simultaneously producing two optical assemblies.

Next, please refer to FIG. 8, which illustrates a schematic diagram of partitioning a large area substrate 80 and simultaneously producing two optical assemblies 81, 82. In FIG. 8, a larger area of the substrate 80 is used, and two or more light source assemblies 81, 82 are set at the same time. The light source component 801 of the light source assembly 81 is disposed opposite to the light source component 802 of the light source assembly 82 and is crossed to each other. In this figure, it may be seen that there is a gap between the adjacent light source component 801, 802, and the light sources component 801, 802 of the other light source assemblies 81, 82 are just placed. With such a configuration, it is possible to place a large number of elements such as an LED chip on the same substrate 80 at the same time, thereby greatly improving the manufacturing efficiency and avoiding waste of the consumables.

In another design example, the multiple light source components and the base may share the same substrate. In other words, the multiple light source components may be constructed of the same substrate as the base. For example, at the time of making, an aluminum substrate or other material may be used to obtain the desired shape by cutting or stamping. The multiple LED chips are set in a predetermined region of the substrate. In order to allow the appropriate current to be received between the LED chips, it is also possible to add the corresponding wires or a conductive plate which may increase the heat dissipation directly to the substrate. The LED chips electrically connect in parallel, in series, or in other corresponding connecting ways via a corresponding conductor or a conductive plate.

In order to increase the heat dissipation effect, the material of the same substrate may include aluminum. Besides aluminum, you may use a variety of different heat dissipation materials. This substrate is connected to the light source described above, so the whole may also be regarded as a radiator. The LED chip or LED module may be directly attached to the substrate, or may be a module, and then fixed to the substrate by means of glue, welding or the like. In addition, a heat dissipating material may be coated between the LED chip and the substrate, for example, a gel-type heat dissipating material that never become harder, and increases the heat transfer effect between the LED chip and the substrate.

In one type of design, the same substrate material is a heat sink. In addition, for the sake of fabrication efficiency, the substrates mentioned herein may be formed by cutting or punching with the same complete material layer or sheet of material. In addition, in different designs, you may also use multiple pieces of material stitching, paste or welding, etc. to constitute a substrate. In addition, the substrate may have more than one layer of material. For example, some layers are wire layers, which are responsible for series-connected LED chips. Some layers are connected to a layer of aluminum plates for heat dissipation. Some layers are insulating layers, avoiding short circuits between circuit elements that may not occur.

In one embodiment, the same substrate described above may be folded to form a three-dimensional hollow light source assembly. For example, we may use a substrate cut into the desired shape. The substrate may have multiple forked strips for placing the LED. The substrate may have a base portion, which is commonly connected to the base. The substrate may be formed by folding, for example, by curling a three-dimensional structure. The substrate may be preliminarily set with a folding groove so that the substrate may accurately and easily fold out the desired corner when folded.

The intermediate portion of the base may have at least one hole to enhance the effect of heat dissipation of the substrate. If it is through the way of folding the substrate, then the bottom of the base area surrounded by circular holes or polygonal holes. The top is extended from the substrate of a number of light source assemblies.

The folded substrate may be directly placed into the injection molding machine to inject a predetermined plastic layer on the inside, outside or both sides of the base area of the substrate. The plastic injection molding machine through the injection molding method may be closely bonded to the substrate base area through the injection molding method.

The outside of the plastic layer corresponds to the inner wall of the light cap. In other words, the base of the plastic molding plastic layer may be directly transferred into or embedded in the corresponding light cap. Screw thread may be produced on the plastic layer. With the screw thread, the plastic layer combines with the light cap by rotation. In addition, the plastic layer may also be designed to snap, groove, bump, etc. to connect with the light cap.

A heat dissipating glue may also be added between the bottom of the base and the inner wall of the light cap to further increase heat transfer. In other words, the heat from the LED chip on the substrate may be transmitted through the substrate to the base region of the substrate and transferred to the light cap through the plastic layer.

In addition, in order to allow the beam to follow the desired beam path, the light source may include an aluminum substrate with multiple LED chips. The multiple LED chips are arranged on the aluminum substrate and the aluminum substrate is extended in a predetermined manner so that different LED chips on the same aluminum substrate emit light toward two or more angles. As described above, the substrate may be an aluminum substrate. At this time, the aluminum substrate may be bent by bending or the like, for example, bending into a curve, or multiple paragraphs bent into multiple relative angles. In this way, in different paragraphs, or different areas of the LED chips may have different light injection angles. By adjusting the relative angle of the aluminum substrate or the substrate of the various materials at different positions, the LED chips may emit light in a desired direction so that the light emission of the entire lighting apparatus conforms to the desired light distribution.

In practically, one of the practices includes bending the aluminum substrate at an upper end at an angle such that different LED chips on both sides of the bent position emit light at different angles. In other words, the LED chip above the bent position emits light toward the first angle and the LED chip below the bent position emits light toward the second angle, wherein the first angle and the second angle remain constant big difference, so that light may be fired in different directions. Typically, the main beam angles of the LED chips are about 120 degrees. In the design, you may make different areas of the LED chips' beam angles part of the overlap in order to avoid the emergence of light spots.

In addition, if it is a common Edison light cap, the center of the light cap is a cylindrical hole. The central axis of the cylindrical hole has a central axis direction. By bending a local region of a substrate such as an aluminum substrate so that at least one or more of the LED chips of the light emitting direction is different from the central axis direction by 30 degrees or more.

In addition, as described above, multiple regions may be set on the substrate for setting the LED chips. The area may have a certain gap between for better cooling effect. For example, the light source assembly has the multiple aluminum substrates, and there are gaps between the multiple aluminum substrates so that air flows between the inner space surrounded by the multiple aluminum substrates and other spaces in the bulb heat dissipation.

In one embodiment, the sum of the widths of the gaps is between one-third and one-half of the sum of the widths of the multiple aluminum substrates. The sum of the widths of the gaps refers to the sum of the gaps between the multiple aluminum substrates, while the light source assembly is formed a three-dimensional structure. The sum of the widths of the multiple aluminum substrates refers to the sum of the widths of the multiple aluminum plates, while the light source assembly is formed a three-dimensional structure.

In order to introduce a current into the LED chip, the bulb apparatus further includes an electrical connection terminal, and the multiple light source components are connected to the driving component through the electrical connection terminal. The electrical connection terminals may be used to form the desired conductive structure with shrapnel, springs, wires or multiple different configurations.

Surely, in addition to the conventional bulb apparatus, the substrate with three-dimensional structure by bending may be used in different lighting apparatus such as downlights and spotlights, etc. The area in which the light source plate is originally set may be changed to multiple light sources set with a substrate in a part of the substrate, and a light source such as an LED chip is set thereon, and then the region of the light source component is bent so that the LED chip faces where the desired place glows.

Figure 9:
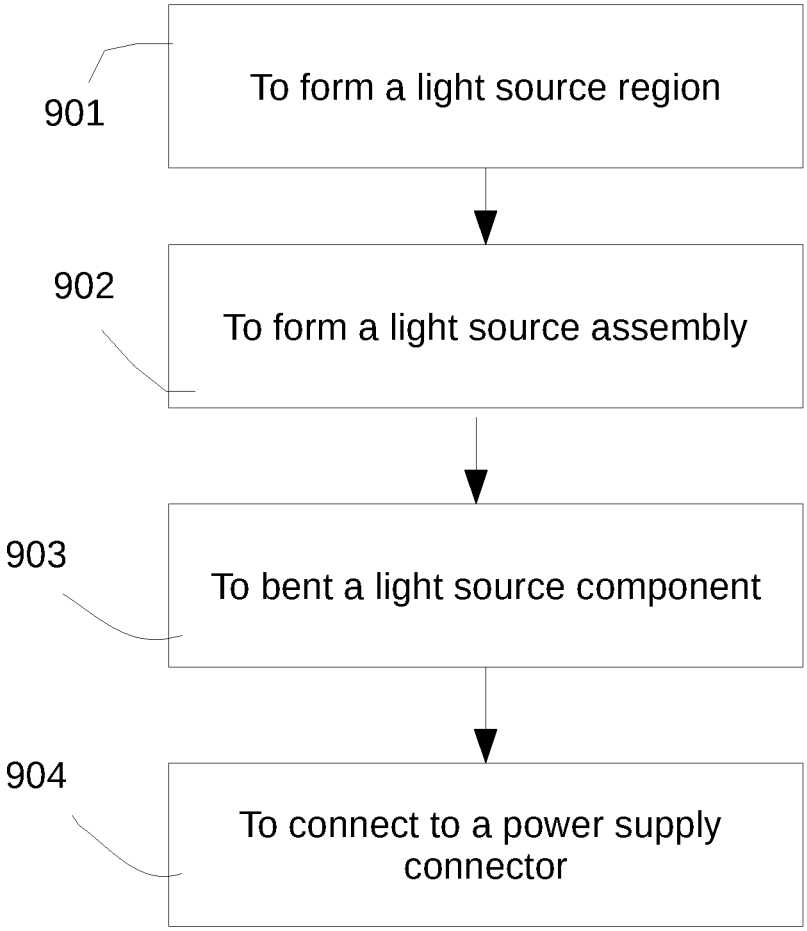
FIG. 9 illustrates a flowchart embodiment of a lighting apparatus.

Please refer to FIG. 9, the flowcharts of FIG. 9, providing a method of manufacturing an illumination apparatus. The method includes the following steps.

First, multiple light source component regions are formed on one substrate (step 901), and multiple LED chips are set in each of the light source component regions, wherein the multiple light source component regions have gaps.

Folding the substrate into a three-dimensional hollow light source assembly (Step 902), and multiple light source component regions and a corresponding multiple LED chips of the substrate form multiple light source members. The gap between the multiple light source component regions helps the air pass through for heat dissipation.

The light source component is bent (step 903) so that different LED chips on both sides of the light source component emit beams toward different angles.

The light source assembly is connected to the power supply connector (step 904).

In other words, the bulb apparatus may be manufactured by this method. Moreover, such a manufacturing method may bring high-efficiency, low-cost technical effects.

In addition, the method may also include forming a plastic layer by injection molding at the bottom of the light source assembly, the plastic layer corresponding to the shape of the power supply connector.

In addition, the method may also include cutting two of the substrates on a sheet, the two substrates being disposed backwards, and the two substrates being staggered on the panels in a portion of the panel. In other words, the method may be for a large area of the substrate with the corresponding LED chip set, and then cut. Since the gap between the light source members is staggered, it is equal to the gap of the substrate of one light, and is the position of the light source plate of the substrate of the other light. Through the approach may not waste material, and may achieve more environmentally friendly and reduce the cost of the effect.

The substrate may include an aluminum substrate, and furthermore, the intermediate sidewall of the light source assembly may further be set with holes to increase the heat dissipation effect, for example, to increase the flow of the gas.

Through the above design method, we may achieve lower manufacturing costs and better cooling efficiency, while maintaining the excellent characteristics of light lighting.

In addition to the above-described embodiments, the present invention may be devised as other variations as long as they remain within the spirit of the invention set forth herein and may remain within the scope of the present invention.

The invention claimed is:

1. A method of manufacturing light apparatuses, comprising:

arranging at least two substrates on the same sheet;

a plurality of light source component regions being formed on one substrate, and the plurality of LED chips being set in each of the light source component regions, wherein there are gaps between two adjacent light source component regions, and the light source component regions of the two substrates are crossed to each other on the same sheet;

cutting the two substrates from the sheet;

bending the substrate to form a three-dimensional hollow light source assembly, the plurality of light source component regions of the substrate and a corresponding plurality of LED chips constituting a light source assembly, the gaps between the multiple light source component regions assisting air to pass through for heat dissipation;

bending the light source components toward different angles; and connecting the light source assembly to a power supply connector.

2. The method of claim 1, further comprising forming a plastic layer by injection molding at a bottom of the light source assembly, a shape of the plastic layer corresponding to the power supply connector.

3. The method of claim 1, wherein the substrate comprises an aluminum substrate.

4. The method of claim 1, wherein a middle sidewall of the light source assembly has holes to increase heat dissipation.

* * * * *